US007942144B2

(12) United States Patent
Derman

(10) Patent No.: US 7,942,144 B2
(45) Date of Patent: May 17, 2011

(54) HEATING SYSTEM AND APPARATUS

(76) Inventor: Donald Derman, New York, NY (US)

( * ) Notice: Subject to any disclaimer, the term of this patent is extended or adjusted under 35 U.S.C. 154(b) by 315 days.

(21) Appl. No.: 12/051,033

(22) Filed: Mar. 19, 2008

(65) Prior Publication Data

US 2009/0235914 A1 Sep. 24, 2009

(51) Int. Cl.
*F24C 9/00* (2006.01)
*F24D 3/08* (2006.01)

(52) U.S. Cl. ..... 126/247; 122/26; 237/2 A; 237/12; 237/19; 237/8 R; 415/199.4; 415/199.1; 415/199.5; 415/501

(58) Field of Classification Search ..... 126/247; 122/26, 19, 8 R; 237/2 A, 12, 19, 8 R; 165/199.4, 165/199.1, 199.5, 501
See application file for complete search history.

(56) References Cited

U.S. PATENT DOCUMENTS 2,090,873 A 8/1937 Lazarus
2,251,344 A 8/1941 Tesch
3,402,702 A * 9/1968 Love ..... 122/26
4,143,639 A 3/1979 Frenette
4,273,075 A 6/1981 Freihage
4,285,329 A * 8/1981 Moline ..... 126/247
4,295,461 A 10/1981 Cummings et al.
4,312,322 A * 1/1982 Freihage ..... 126/247
4,343,291 A 8/1982 Clausen
4,357,931 A 11/1982 Wolpert et al.
4,365,614 A 12/1982 Grover
4,381,762 A 5/1983 Ernst
4,387,701 A 6/1983 Gibbons
4,419,980 A 12/1983 Leary et al.
4,424,797 A 1/1984 Perkins
4,426,793 A 1/1984 Kuboyama
4,454,861 A 6/1984 Grenier
4,462,386 A * 7/1984 Powell ..... 126/247
4,481,934 A 11/1984 Stephenson
4,494,524 A 1/1985 Wagner
4,499,913 A 2/1985 Frenette
4,590,918 A * 5/1986 Kuboyama ..... 126/247
4,596,077 A 6/1986 Kuboyama
4,646,714 A 3/1987 Bolin
4,678,400 A * 7/1987 Kuboyama ..... 415/199.4
4,685,329 A * 8/1987 Burgess ..... 73/152.44
4,685,443 A * 8/1987 McMurtry ..... 126/247
4,696,283 A 9/1987 Kohlmetz et al.
4,721,066 A 1/1988 Newman, Sr. et al.
4,781,151 A 11/1988 Wolpert, Jr. et al.
5,046,480 A * 9/1991 Harris ..... 126/247
5,056,502 A * 10/1991 Eyzaguirre et al. ..... 126/247
5,392,737 A 2/1995 Newman, Sr. et al.
5,937,797 A 8/1999 Ban et al.
6,056,502 A * 5/2000 Takemura et al. ..... 414/686
6,547,153 B1 * 4/2003 Davis ..... 237/19
6,823,820 B2 11/2004 Thoma

* cited by examiner

*Primary Examiner* — Steven B McAllister
*Assistant Examiner* — Nikhil Mashruwala
(74) *Attorney, Agent, or Firm* — Frommer Lawrence Haug LLP; Thomas F. Presson; Russell P. Blaise

(57) ABSTRACT

A heating apparatus and a system that utilize friction to generate thermal energy. The heating apparatus comprises a housing unit, a plurality of heating chambers for generating heat, an actuating unit, a shaft; and at least one blade unit. Each heating chamber comprises a stationary disc member, a rotating disc member, and a medium disposed between the stationary disc member and the rotating disc member. The actuating unit drives the rotating disc member in the heating chamber to generate thermal energy by friction among the stationary disc member, the rotating disc member, and the medium. Thermal energy generation is controlled by rotating speed, diameter of the disc member, and contact pressure between the rotating disc member and the stationary disc member. Tube members can also be used in the heating chambers.

9 Claims, 3 Drawing Sheets

HEATING SYSTEM AND APPARATUS

BACKGROUND

1. Field of the Invention

The present invention relates generally to a heating apparatus. More specifically, the present invention is directed to a heating system that utilizes friction to generate thermal energy. The heating system and apparatus generate thermal energy by sequentially passing air through a plurality of heating chambers, each chamber generating thermal energy by friction between a moving disc member, a stationary disc member, and a medium.

2. Background Discussion

One type of conventional heating apparatus generates heat by use of multistage rotary members, each of which comprises a tubular casing and two more rotary means disposed on a multistage manner. An air friction heat generating area is formed in a slight gap of a rotating area of each rotary member and a suctioned air is heated on each stage level while reducing or pressurizing the air pressure within the chamber at a continuously balanced level.

One type of conventional space heater uses a small electric motor that rotates an elongated cylindrical drum on a vertical axis. The drum has a small clearance with another annular chamber. A supply of light lubricant normally occupies the lower portion of the annular chamber but rises to fill the chamber during rotation. Heat is generated due to the friction between the two chambers.

One concern with conventional heating apparatus and systems that utilize friction to generate thermal energy is that the heating chambers are easily overheated or under heated. When overheated, the heating chamber has a high temperature that is harmful to both the apparatus and a user who may be burned while using the apparatus. When under heated, the heating chamber does not generate enough heat.

SUMMARY

Accordingly, the present invention is directed to an apparatus and system for providing thermal energy by friction in a controllable manner.

One embodiment of the present invention is directed to a heating apparatus that includes a housing unit, a plurality of heating chambers, an actuating unit, a shaft, and at least a blade unit. The housing unit has a base and a plurality of openings. The actuating unit is coupled to the housing unit and adapted to provide power to the heating apparatus. The shaft is operably coupled to the actuating unit and to the plurality of heating chambers. The blade unit coupled to the shaft for circulating a fluid around the plurality of heating chambers. Each heating chamber further comprises a stationary disc member, a rotating disc member; and a medium disposed between the stationary disc member and the rotating disc member. Thermal energy is generated by friction among the stationary disc member, the rotating disc member, and the medium.

Another embodiment of the present invention is directed to a baseboard heater that includes a housing unit having a support and a plurality of openings, a plurality of heating chambers for generating heat, an actuating unit coupled to the housing unit and adapted to provide power to the baseboard heating apparatus, a shaft is operably coupled to the actuating unit and to the plurality of heating chambers, and a control panel controls temperature and heating time of the baseboard heating apparatus. Each heating chamber includes a stationary tube member, a rotating tube member, and a medium disposed between the stationary tube member and the rotating tube member. The axis of each tube member is parallel with a horizontal direction, and thermal energy is generated by friction among the stationary tube member, the rotating tube member, and the medium.

BRIEF DESCRIPTION OF THE DRAWINGS

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages, embodiments and novel features of the invention may become apparent from the following description of the invention when considered in conjunction with the drawings. The following description, given by way of example, but not intended to limit the invention solely to the specific embodiments described, may best be understood in conjunction with the accompanying drawings, in which.

DETAILED DESCRIPTION

Figure 1:
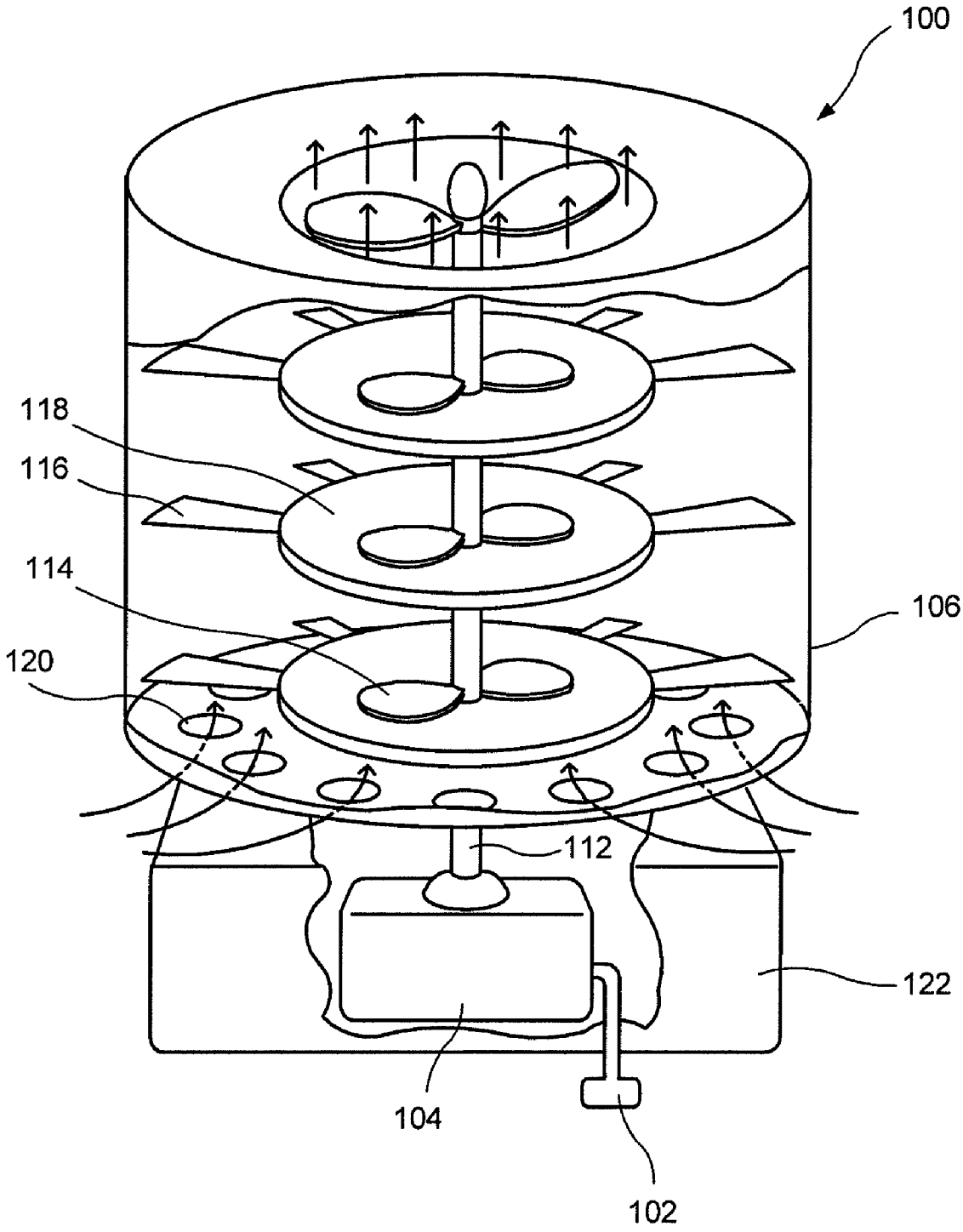
FIG. 1 illustrates a schematic view of a heating apparatus according one embodiment of the invention.

It is noted that in this disclosure and particularly in the claims and/or paragraphs, terms such as "comprises," "comprised," "comprising," and the like can have the meaning attributed to it in U.S. patent law; that is, they can mean "includes," "included," "including," "including, but not limited to" and the like, and allow for elements not explicitly recited. Terms such as "consisting essentially of" and "consists essentially of" have the meaning ascribed to them in U.S. patent law; that is, they allow for elements not explicitly recited, but exclude elements that are found in the prior art or that affect a basic or novel characteristic of the invention. These and other embodiments are disclosed or are apparent from and encompassed by, the following description.

Turning to the drawings, wherein like reference numerals refer to like elements, the invention is illustrated.

FIG. 1 illustrates a schematic view of a heating apparatus 100 according one embodiment of the present invention. The heating apparatus, 100, includes a switch, 102, an actuating unit, 104, a housing unit, 106, a shaft, 112, a plurality of heating chambers, 118(*a*) . . . (*n*) (where "n" is any suitable number). Chambers 118(*a*) . . . (*n*) are generally referred to as 118 hereinafter. A plurality of blades 114(*a*) . . . (*n*) (where "n" is any suitable number, generally referred to as 114 hereinafter.) disposed on top of each heating chambers 118, and a plurality of wall mounts, 116(*a*) . . . (*n*) (where "n" is any suitable number, generally referred to as 116 hereinafter.) for securing each heating chamber 118 to the housing unit 106. The heating apparatus 100 is filled with heat transport fluid such as air. The switch 102 turns on and off the current flow to the actuating unit 104. The housing unit 106 protects, for example, the heating chambers 118 and the shaft 112. The housing unit 106 further has a base 122 for protecting the actuating unit 104 and providing support to the heating apparatus 100. The housing unit 106 also has a plurality of openings 120 to allow air or other types of fluid to pass through.

The shaft 112, whose axis is in a substantially vertical direction, is coupled with the actuating unit 104, the blades 114, and the heating chambers 118. When the switch 102 permits the actuating unit 104 to be actuated, the shaft 112 rotates with the actuating unit 104 and causes the blades 114 and rotating disc members 1186 (which will be described in detail in the following sections) in the heating chambers 118 to rotate so that thermal energy is generated in the heating chamber 118 by friction.

Fluid circulated by the blade 114 is exchanged between inside and outside the housing unit 106 so that thermal energy of the heating chamber 118 is carried outside the heating apparatus 100 by the fluid, which can be air, water, oil, or other liquid or vapor fluid with suitable properties. Since the apparatus 100 is used with fluid, proper seal of concerned units such as the actuating unit 104 is desired.

At least one blade 114 is used to circulating the fluid. Each heating chamber 118 may have one or more blades 114. For example, as shown in FIG. 1, one blade is used for each heating chamber 118. The surface area covered by the blade 114 is preferably to be the same as the surface area of the heating chamber 118. The number of blades 114 disposed to one heating chamber 118 depends on many factors including the surface area of the heating chamber 118, space between the heating chamber 118 and the housing unit 106, number of openings 120 in the housing unit 106, rotating speed of the actuating unit 104, and fluid type used in the heating apparatus 100.

The actuating unit 104 is preferably a motor because it works quietly and is economically affordable. Electricity to the motor may be provided through a variety of sources including a wall outlet, battery, solar panel, or fuel cells. The actuating unit 104 is not limited to a motor. The actuating unit 104 can be any device that gathers mechanical power such as a unit powered by wind or hydraulic energy. In a case that the heating apparatus 100 uses wind power to drive the actuating unit 104, it has special advantages to be used in areas where cold weather is caused by wind.

The plurality of heating chambers 118 may, for example, be the same size or gradually decrease their size or increase their size depending on the distance away from the actuating unit 104. The distance between two heating members 118 may, for example, be fixed or being gradually increased or being gradually decreased depending on the distance away from the actuating unit 104.

Figure 2:
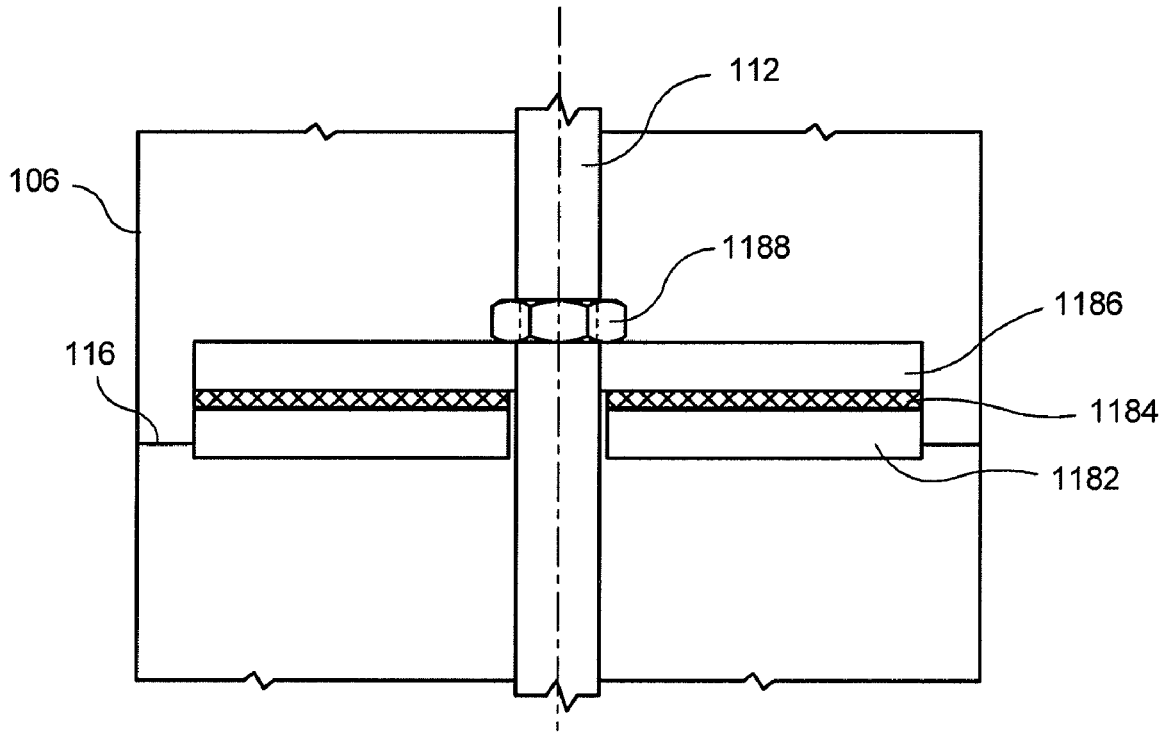
FIG. 2 illustrates a schematic view of an example of a heating chamber.

FIG. 2 shows a schematic view of a heating chamber, 118. Blades are not shown in FIG. 2. Elements shown in FIG. 2 that have the same reference numerals as those in FIG. 1 are not described. According to the current invention, each heating chamber 118 comprises a stationary disc member, 1182, a rotating disc member, 1186, a medium, 1184, disposed between the stationary disc member 1182 and the rotating disc member 1186, and a tightening nut, 1188, coupled to the shaft 112 and the rotating disc member 1186. The stationary disc member 1182 is secured to the housing unit 106 by wall mounts 116. The rotating disc member 1186 contacts the stationary member 1182 so that friction is generated when the rotating disc member 1186 rotates. The gap between the rotating disc member 1186 and the stationary disc member 1182 in FIG. 2 is enlarged to show the medium 1184 thereof.

The medium 1184 disposed between the rotating disc member 1186 and the stationary disc member 1182 may, for example, be oil with high temperature resistance. The oil prevents seizure when the rotating member 1186 starts to rotate and distributes high localized temperature at high rotating speed due to uneven contact between the rotating disc member 1186 and the stationary member 1182. The medium 1184 is preferred to have high heat capacitance and high heat conductance. Engine oils such as 10W30 or 5W30 may, for example, be used as the medium 1184.

Overheat or under heat is controlled by controlling thermal energy generation in each heating chamber 118 in multiple ways. For example, the rotating speed of the rotating disc member 1186 is set to be adjustable. When the rotating speed is high, the thermal generation rate is high. Contact pressure between the rotating disc member 1186 and the stationary disc member 1182 is varied by changing mass of the rotating disc member 1186 or by adjusting external pressure caused by the nut 1188. Higher contact pressure typically generates more thermal energy. The diameter of the disc members 1182 and 1186 is also predetermined to satisfy a plurality of requirements such as apparatus dimension requirement, targeted temperature of the heating chamber 118, vibration of the shaft 112, and thermal energy generation rate. When a larger diameter is used, more thermal energy is generated.

The heating apparatus 100 may further have a second protective housing unit 122 (not shown in FIG. 1) for adding extra safety precaution. The second protective housing unit 122 covers the entire heating apparatus 100 so that should a moving part such as the actuating unit 104, the shaft 112, or the rotating disc member 1186 gets loose or the apparatus 100 is over heated, the second protective housing unit 122 separates the danger from a user. The second housing unit 122 typically has openings at the top portion and bottom portion for exchanging thermal energy.

Figure 3:
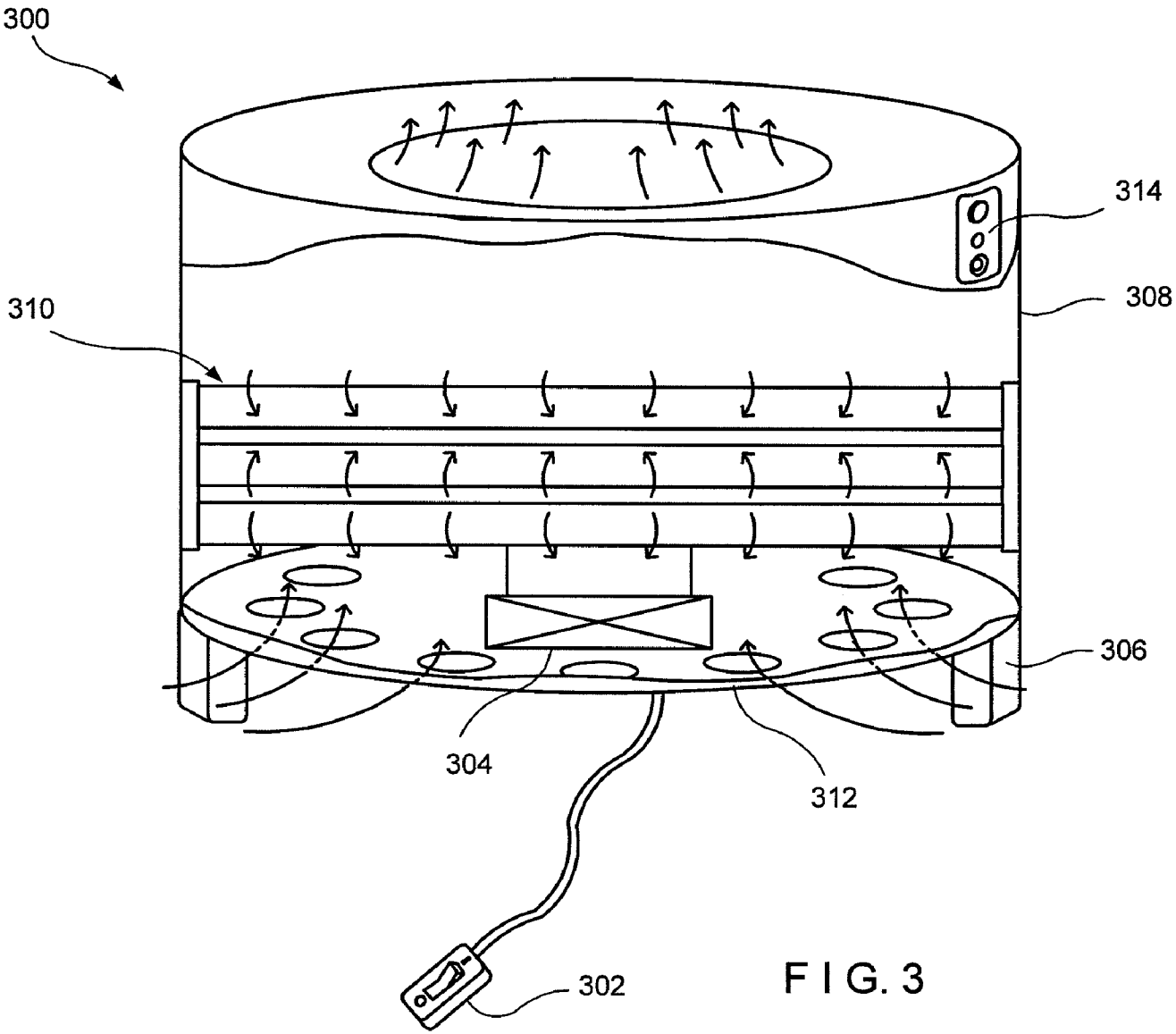
FIG. 3 illustrates a schematic view of an example of a baseboard heating apparatus according another embodiment of the invention.

FIG. 3 illustrates a schematic view of an example of a baseboard heating apparatus 300 according another embodiment of the invention. The heating apparatus, 300, as shown in FIG. 3 includes a switch 302, a housing unit, 308, a motor, 304, a plurality of heating chambers, 310(*a*) . . . (*n*) ("n" is any number. 310(*a*) . . . (*n*) is generally 310 hereinafter.), and a control panel, 312. The housing unit 308 further comprises two supports, 306(*a*) and 306(*b*), hereinafter generally 306, to support the heating apparatus 300 so that the heat apparatus 300 stands alone. The motor 304 is contained in a base 312 of the housing unit 308. The switch 302 controls electricity to the heating apparatus 300. Each heating chamber 310 includes a stationary tube member 3102, a rotating tube member 3106, and a medium 3104 disposed between thereof. An axis of each tube members 3102 and 3106 is substantially parallel with a horizontal direction. The control panel 312 is operable to control temperature and heating time and indicate current temperature and targeted temperature. The control panel 312 is also operable to warn a user by producing a sound signal or a blinking signal or automatically turn off when the heating apparatus 300 is overheated or other danger is detected.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A heating apparatus comprising:

a housing unit having a base and at least nine openings;

at least three heating chambers for generating heat;

an actuating unit coupled to the housing unit and adapted to provide power to the heating apparatus;

a shaft, disposed in a vertical direction, operably coupled to the actuating unit and to the at least three heating chambers; and at least two blade units in at least three heating chambers coupled to the shaft for circulating a heat transport fluid around the at least three heating chambers; and at least four wall mounts in each of the at least three heating chambers for securing the heating chambers to the housing unit, wherein each heating chamber comprises:

a stationary disc member;

a rotating disc member; and a medium disposed between the stationary disc member and the rotating disc member, and wherein thermal energy is generated by friction among the stationary disc member, the rotating disc member, and the medium, wherein the housing unit is filled with the heat transport fluid, the heat transport fluid being different from the medium of the heating chamber, and wherein the at least three heating chambers gradually increase in size as function of distance from the actuating unit, and wherein the distance between two adjacent heating chambers increases or decreases as a function of a distance from the actuating unit.

2. The heating apparatus according to claim 1, wherein the medium is in a substantially liquid form.

3. The heating apparatus according to claim 2, wherein the medium comprises a lubricant.

4. The heating apparatus according to claim 1, wherein the actuating unit is a motor.

5. The heating apparatus according to claim 4, wherein the motor uses electricity outputted from at least one of wall outlet, battery, solar panel, and fuel cell.

6. The heating apparatus according to claim 1 further comprising a control unit that controls temperature, power, and heating period of the heating apparatus.

7. The heating apparatus according to claim 1 further comprising a second housing unit.

8. The heating apparatus according to claim 1, wherein the actuating unit further utilizes wind power, hydraulic power, or solar power.

9. The heating apparatus according to claim 1, wherein the contact pressure between the rotating disc member and the stationary disc member is adjusted by mass of the rotating disc member or a nut.

* * * * *